US005857772A

United States Patent [19]

Washington

[11] Patent Number: 5,857,772

[45] Date of Patent: Jan. 12, 1999

[54] LID WITH A ROTATABLE PADDLE FOR STIRRING PAINT

[76] Inventor: Booker T. Washington, 1388 Gleason Ave., Memphis, Tenn. 38106

[21] Appl. No.: 988,688

[22] Filed: Dec. 11, 1997

[51] Int. Cl.[6] ..... B01F 7/20

[52] U.S. Cl. ..... 366/243; 366/605

[58] Field of Search ..... 366/130, 241–248, 366/252, 276, 277, 255–260, 342, 343, 605

[56] References Cited

U.S. PATENT DOCUMENTS

| | | | |
|---|---|---|---|
| 54,846 | 5/1866 | Bridgman | 366/242 |
| 1,038,204 | 9/1912 | Roberts | 366/242 |
| 1,068,450 | 7/1913 | Roberts | 366/243 |
| 1,133,413 | 3/1915 | Stough | 366/243 |
| 1,165,307 | 12/1915 | Baltzley | 366/243 |
| 1,177,295 | 3/1916 | Beckner et al. | 366/242 |
| 1,237,585 | 8/1917 | Tripke | 366/243 |
| 1,238,461 | 8/1917 | Tripke | 366/243 |
| 1,798,757 | 3/1931 | Roberts | 366/242 |
| 1,948,431 | 2/1934 | Rolph | 366/243 |
| 2,162,348 | 6/1939 | Hacmac | 366/243 |
| 2,207,335 | 7/1940 | Thomas et al. | 366/242 |
| 2,749,098 | 6/1956 | Johnson | 366/243 |
| 3,115,664 | 12/1963 | Del Ponte . | |
| 3,744,767 | 7/1973 | Blasnik | 366/243 |
| 4,422,770 | 12/1983 | Geible | 366/248 |

*Primary Examiner*—Charles E. Cooley
*Attorney, Agent, or Firm*—David L. Volk

[57] ABSTRACT

A lid has a first side, and a second side opposite the first side. The lid is adapted to cover an opening of a paint can such that the second side faces an inside of the paint can. An internally threaded first shaft is mounted to the lid such that the first shaft is rotatable about a longitudinal axis thereof with respect to the lid. A paddle is connected to the first shaft on the second side of the lid. An externally threaded second shaft is partially received within the first shaft and extends generally perpendicularly outward from the first side of the lid. The first shaft is rotated when the second shaft is translated along the first shaft. In another embodiment, the second shaft is not externally threaded, but is formed from an elongated planar member coiled about a longitudinal axis thereof, and the first shaft has a coiled internal slot configured to receive the second shaft.

9 Claims, 5 Drawing Sheets

LID WITH A ROTATABLE PADDLE FOR STIRRING PAINT

BACKGROUND OF THE INVENTION

1. Field of the Invention

The present invention relates to paint can lids and to devices for stirring substances.

2. Description of the Related Art

Painting can be a messy job. Stirring paint in paint cans with a conventional stirrer sometimes leads to splashing and spillage of paint. U.S. Pat. No. 4,422,770 to Geible shows a stirrer which extends through a paint can lid and is powered by a hand drill. Although this invention permits stirring of paint while the opening of the can is covered, it requires operation by a hand drill, which can be cumbersome.

What is needed is a device which can stir paint in the can while the opening of the can is covered, which stirs paint easily, efficiently, and effectively, and which does not require operation by a drill.

SUMMARY OF THE INVENTION

The paint stirring apparatus of the present invention includes a lid having a first side, and a second side opposite the first side. The lid is adapted to cover an opening of a paint can such that the second side faces an inside of the paint can. An internally threaded first shaft is mounted to the lid such that the first shaft is rotatable about a longitudinal axis thereof with respect to the lid. A paddle is connected to the first shaft on the second side of the lid.

An externally threaded second shaft is partially received within the first shaft and extends generally perpendicularly outward from the first side of the lid. The first shaft is rotated when the second shaft is translated along the first shaft, thus causing the paddle to stir the paint within the can.

In another embodiment, the second shaft is not externally threaded, but is formed from an elongated planar member coiled about a longitudinal axis thereof, and the first shaft has a coiled internal slot configured to receive the second shaft.

The second shaft is surrounded by a spring configured to urgingly extend the second shaft away from the first side of the lid. A handle is provided at a distal end of the second shaft, and the spring extends between the handle and the lid. When the handle of the second shaft is pushed toward the lid, the spring compresses and the first shaft spins, causing the paddle to stir the paint. When the handle is released, the spring extends the second shaft away from the lid, and the first shaft spins in a reverse direction, further stirring the paint.

The spring and the first shaft on the first side of the lid are surrounded and concealed by an extendable and collapsible sleeve, for protection of the spring and to enhance the appearance of the invention.

Still further features and advantages will become apparent from the ensuing description and drawings.

DETAILED DESCRIPTION

Figure 1:
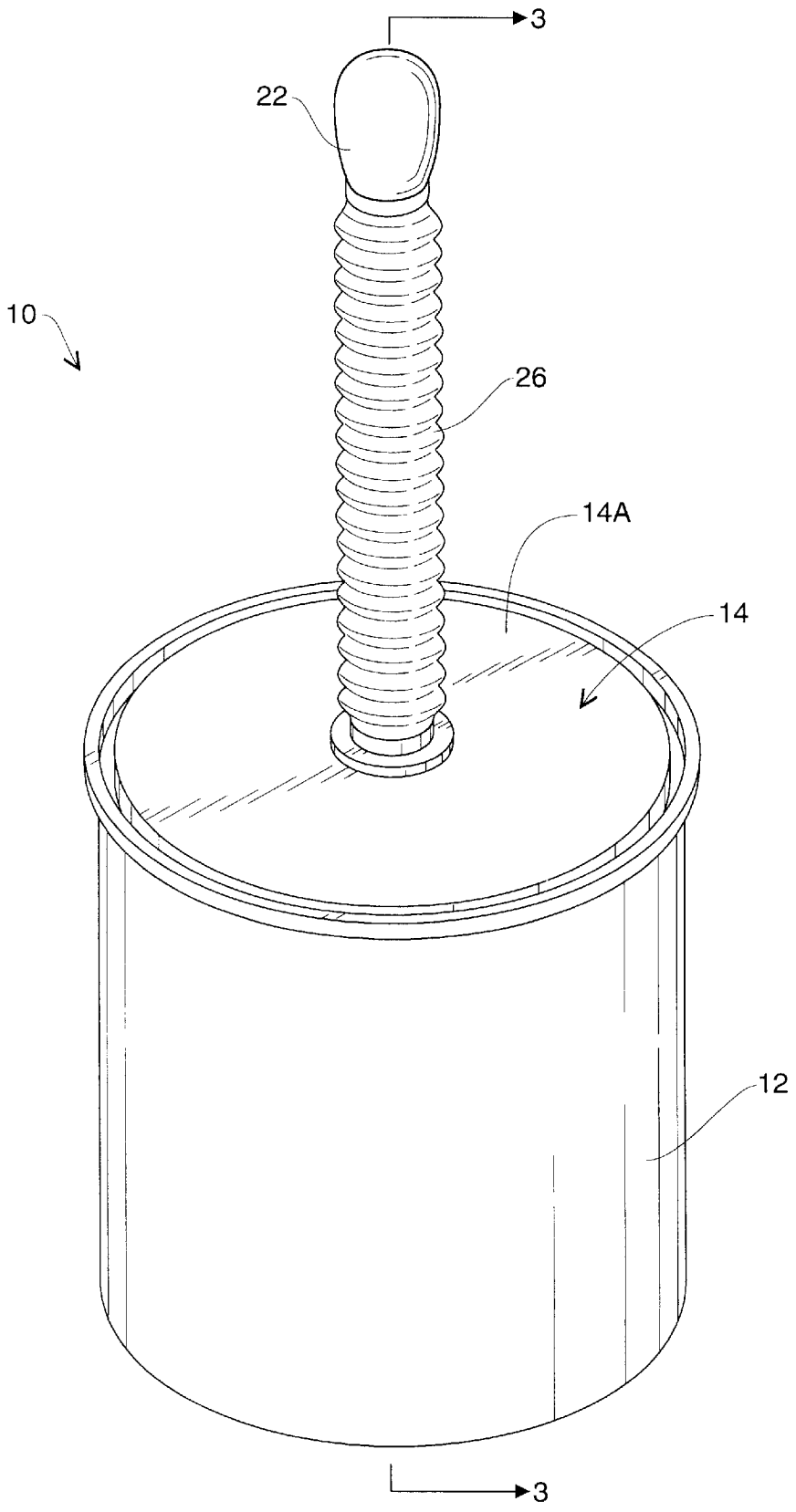
FIG. 1 is a perspective view of a paint stirring apparatus of the present invention, shown affixed to a paint can.
Figure 2:
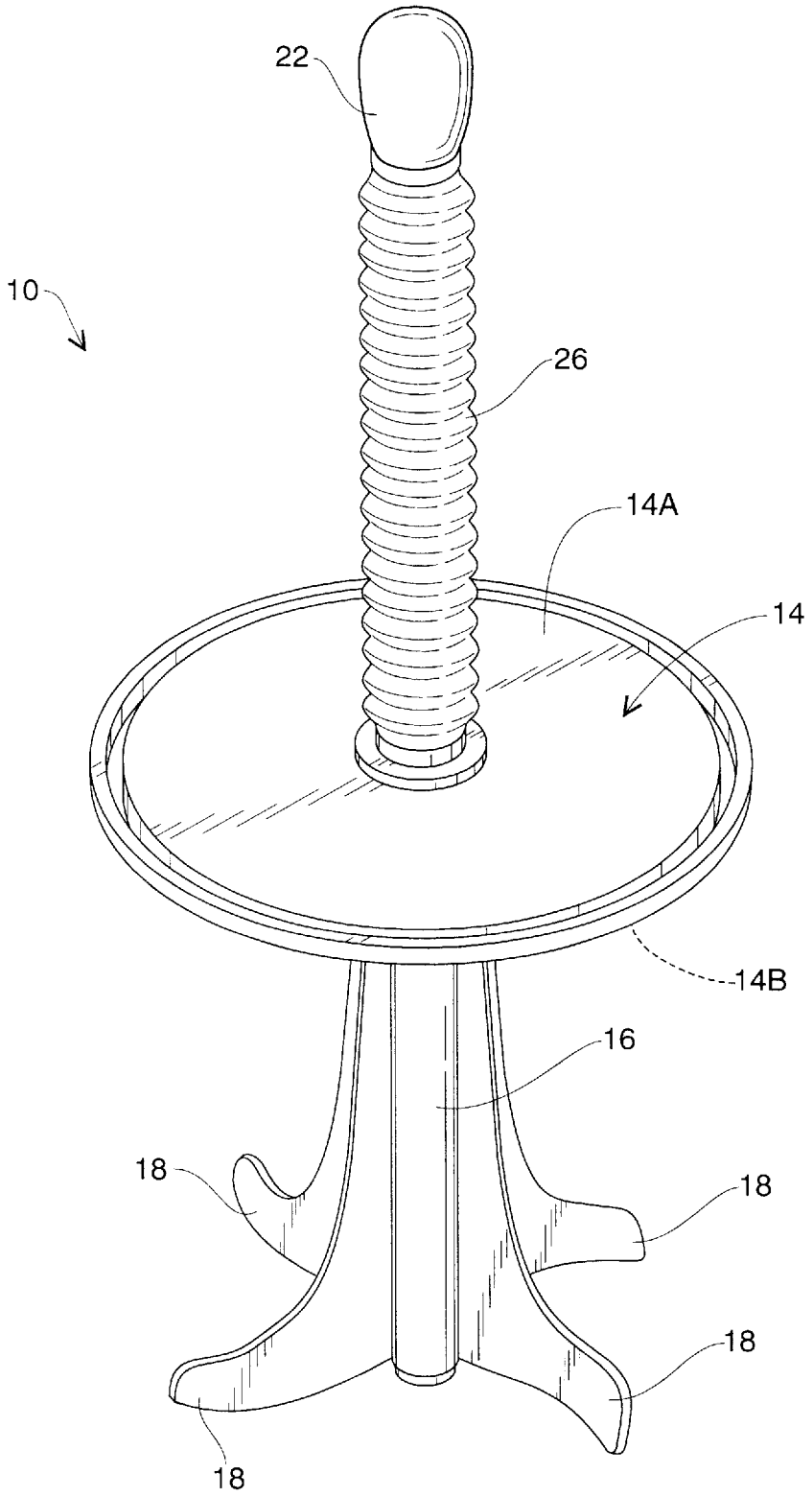
FIG. 2 is a perspective view of the apparatus, shown without the paint can.
Figure 3:
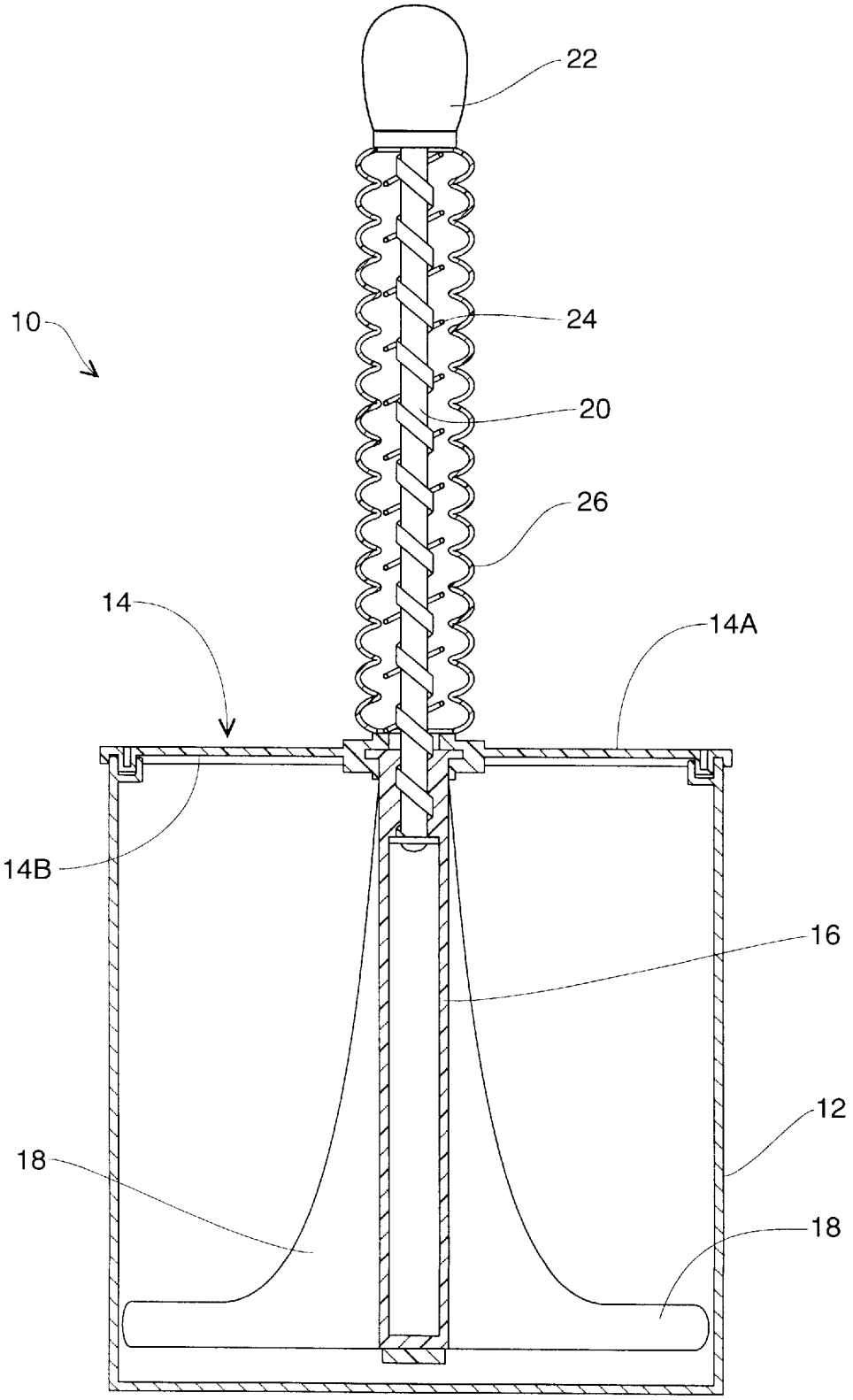
FIG. 3 is a cross-sectional view taken along line 3—3 of FIG. 1.

FIG. 1 is a perspective view of a paint stirring apparatus 10 of the present invention, shown affixed to a paint can 12. FIG. 2 is a perspective view of the apparatus 10, shown without the paint can 12. FIG. 3 is a cross-sectional view taken along line 3—3 of FIG. 1. Referring to FIGS. 1–3, the paint stirring apparatus 10 includes a lid 14 having a first side 14A, and a second side 14B opposite the first side 14A. The lid 14 is adapted to cover an opening of the paint can 12 such that the second side 14B faces am inside of the paint can 12.

A first shaft 16 is mounted to the lid 14 such that the first shaft 16 is rotatable about a longitudinal axis thereof with respect to the lid 14. A plurality of paddles 18 are connected to the first shaft 16 on the second side 14B of the lid 14. The portion of the first shaft 16 closest to the lid 14 is internally threaded.

An externally threaded second shaft 20 is partially received within the first shaft 16 and extends generally perpendicularly outward from the first side 14A of the lid 14. A handle 22 is provided at a distal end of the second shaft 20. A spring 24 surrounds the second shaft 20 and extends between the handle 22 and the lid 14. The spring 24 is configured to urgingly extend the second shaft 20 away from the first side 14A of the lid 14.

Figure 4:
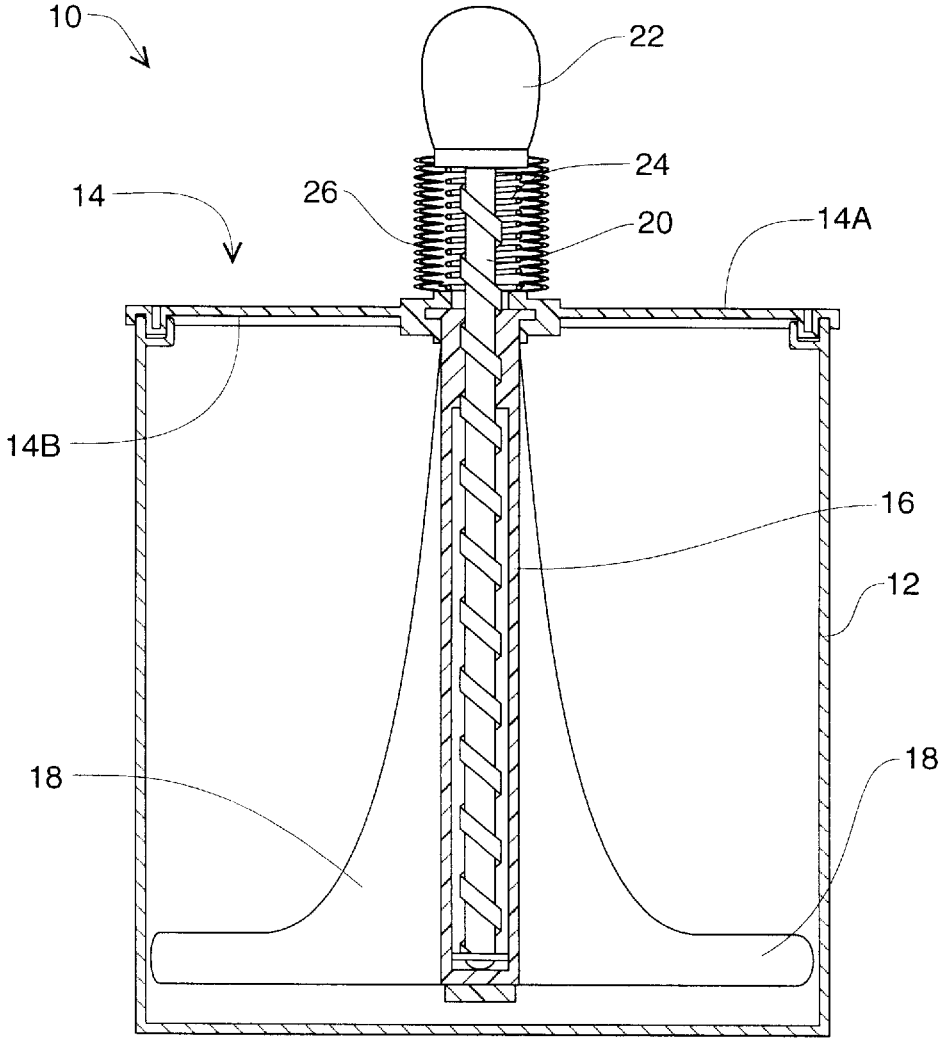
FIG. 4 is a cross-sectional view similar to FIG. 3, showing the second shaft translated into the hollow portion of the first shaft.

A portion of the first shaft 16 next to the internally threaded portion of the first shaft 16 is hollow. FIG. 4 is a cross-sectional view similar to FIG. 3, showing the second shaft 20 translated into the hollow portion of the first shaft 16. In this view, the spring 24 is compressed. When the handle 22 of the second shaft 20 is pushed toward the lid 14, the spring 24 compresses and the first shaft 16 spins due to the translation of the second shaft 20 through the first shaft 16. This causes the paddles 18 to stir the paint.

When the handle 22 is released, the spring 24 extends the second shaft 20 away from the lid 14, and the first shaft 16 spins in a reverse direction, further stirring the paint.

The spring 24 and the first shaft 16 on the first side 14A of the lid 14 are surrounded and concealed by an extendable and collapsible sleeve 26, for protection of the spring 24 and to enhance the appearance of the invention.

Figure 5:
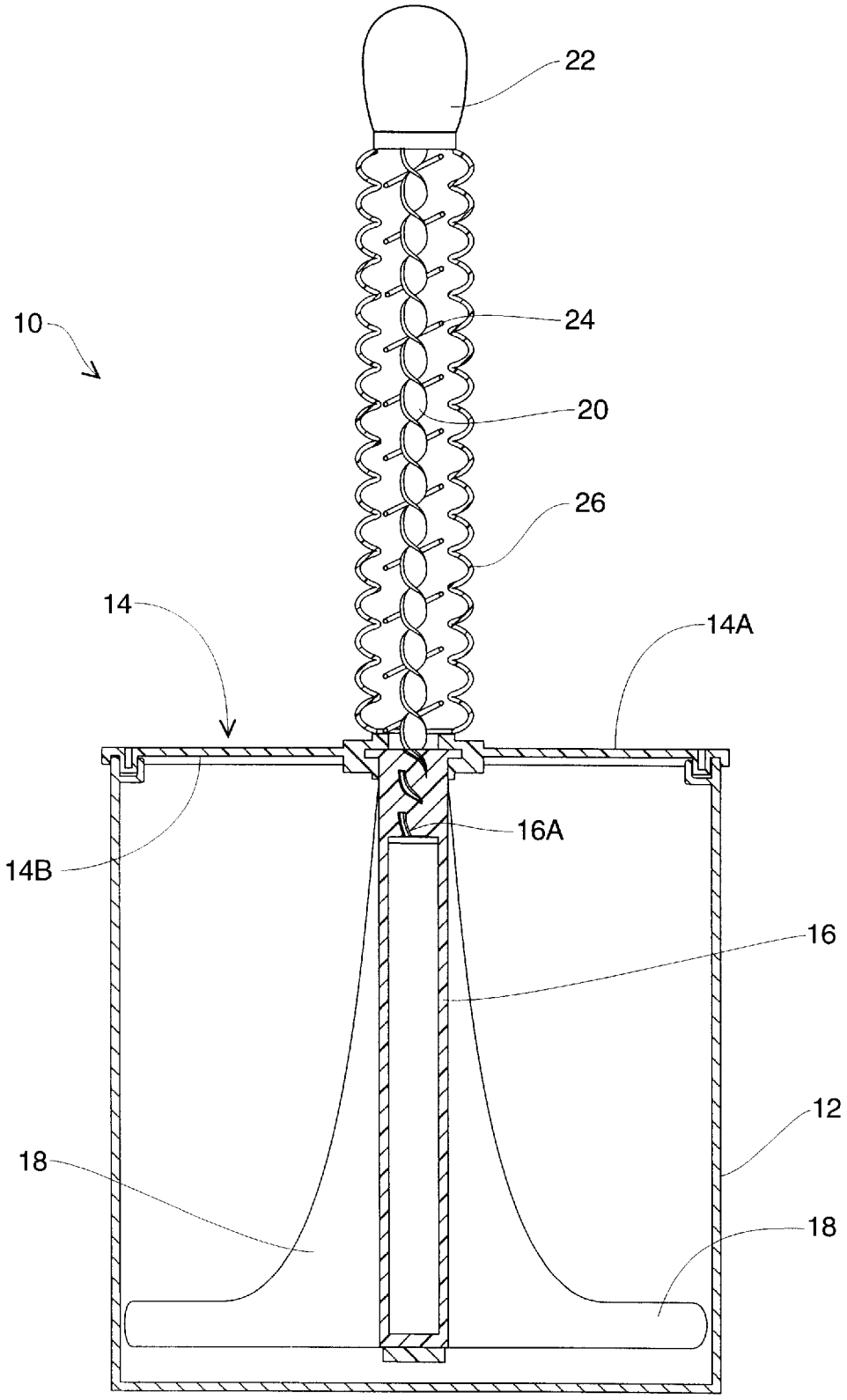
FIG. 5 is cross-sectional view similar to FIG. 3, showing another embodiment.

FIG. 5 is cross-sectional view similar to FIG. 3, showing another embodiment. In this embodiment, the second shaft 20 is not externally threaded, but is formed from an elongated planar member coiled about a longitudinal axis thereof, and the first shaft 16 has a coiled internal slot 16A configured to receive the second shaft 20. The operation of this embodiment is the same as described for the prior embodiment.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A paint stirring apparatus comprising:

a. a lid having a first side, and a second side opposite the first side;

b. the lid adapted to cover an opening of a paint can such that the second side faces an inside of the paint can;

c. an internally threaded first shaft mounted to the lid such that the first shaft is rotatable about a longitudinal axis thereof with respect to the lid;

d. a paddle connected to the first shaft on the second side of the lid;

e. an externally threaded second shaft partially received within the first shaft and extending generally perpendicularly outward from the first side of the lid;

f. the second shaft on the first side of the lid being surrounded by an extendable and collapsible sleeve; and g. wherein the first shaft is rotated when the second shaft is translated along the first shaft.

2. The paint stirring apparatus of claim 1, wherein the second shaft is surrounded by a spring configured to urgingly extend the second shaft away from the first side of the lid, and the sleeve surrounds the spring.

3. The paint stirring apparatus of claim 2, further comprising a handle at a distal end of the second shaft and wherein the spring extends between the handle and the lid.

4. A paint stirring apparatus comprising:

a. a lid having a first side, and a second side opposite the first side;

b. the lid adapted to cover an opening of a paint can such that the second side faces an inside of the paint can;

c. a second shaft formed from an elongated planar member coiled about a longitudinal axis thereof, the second shaft extending generally perpendicularly outward from the first side of the lid;

d. a first shaft having a coiled internal slot configured to receive the second shaft, the first shaft mounted to the lid such that the first shaft is rotatable about a longitudinal axis thereof with respect to the lid;

e. a paddle connected to the first shaft on the second side of the lid;

f. the second shaft on the first side of the lid being surrounded by an extendable and collapsible sleeve; and g. wherein the first shaft is rotated when the second shaft is translated along the first shaft.

5. The paint stirring apparatus of claim 4, wherein the second shaft is surrounded by a spring configured to urgingly extend the second shaft away from the first side of the lid, and the sleeve surrounds the spring.

6. The paint stirring apparatus of claim 5, further comprising a handle at a distal end of the second shaft and wherein the spring extends between the handle and the lid.

7. A paint stirring apparatus comprising:

a. a lid having a first side, and a second side opposite the first side;

b. the lid adapted to cover an opening of a paint can such that the second side faces an inside of the paint can;

c. a second shaft formed from an elongated planar member coiled about a longitudinal axis thereof, the second shaft extending generally perpendicularly outward from the first side of the lid;

d. a first shaft having a slot configured to receive the second shaft, the first shaft mounted to the lid such that the first shaft is rotatable about a longitudinal axis thereof with respect to the lid;

e. a paddle connected to the first shaft on the second side of the lid;

f. the second shaft on the first side of the lid being surrounded by an extendable and collapsible sleeve; and g. wherein the first shaft is rotated when the second shaft is translated through the slot of the first shaft.

8. The paint stirring apparatus of claim 7, wherein the second shaft is surrounded by a spring configured to urgingly extend the second shaft away from the first side of the lid, and the sleeve surrounds the spring.

9. The paint stirring apparatus of claim 8, further comprising a handle at a distal end of the second shaft and wherein the spring extends between the handle and the lid.

* * * * *